United States Patent [19]

Gorham

[11] Patent Number: 4,545,080

[45] Date of Patent: Oct. 8, 1985

[54] DISPOSABLE UNDERARM PERSPIRATION PAD

[76] Inventor: Mary Gorham, 7843 Gleason Dr., Knoxville, Tenn. 37919

[21] Appl. No.: 615,257

[22] Filed: May 30, 1984

[51] Int. Cl.[4] ..... A41D 27/13

[52] U.S. Cl. ..... 2/54; 2/56

[58] Field of Search ..... 2/53, 54, 55, 56, 57, 2/58

[56] References Cited

U.S. PATENT DOCUMENTS

| | | | |
|---|---|---|---|
| 2,747,193 | 5/1956 | Pulsifer | 2/56 |
| 3,145,391 | 8/1964 | Tyrrell | 2/56 |
| 3,259,911 | 7/1966 | Tyrrell | 2/56 |
| 3,727,237 | 4/1973 | Glatt | 2/56 |

FOREIGN PATENT DOCUMENTS

| | | | |
|---|---|---|---|
| 2822588 | 11/1979 | Fed. Rep. of Germany | 2/56 |
| 2841365 | 4/1980 | Fed. Rep. of Germany | 2/56 |
| 3141126 | 4/1983 | Fed. Rep. of Germany | 2/56 |
| 2098996 | 3/1972 | France | 2/56 |
| 2499832 | 8/1982 | France | 2/56 |

*Primary Examiner*—Louis K. Rimrodt
*Attorney, Agent, or Firm*—Pitts and Brittian

[57] ABSTRACT

An underarm perspiration pad for being releasably secured within a garment (12) proximate the underarm area (14) of such garment for protecting the garment (12) from damage resulting from contact with perspiration and for absorbing perspiration from the underarm skin surface of a wearer of the garment (12). The pad (10) comprises a first exterior panel (16) and a second exterior panel (20) joined at their peripheral edges (26, 28) to enclose a perspiration absorbent filler (24). The first exterior panel (16) contacts the skin surface of the wearer of the garment (12) and serves to absorb perspiration from the skin from the wearer and to wick such perspiration to the absorbent filler (24) where it is retained. The second exterior panel (20) is fabricated of a perspiration impervious material and prohibits perspiration from contacting the garment (12). Further, the second exterior panel (20) is provided with means for releasably securing the pad (10) to the garment (12).

9 Claims, 4 Drawing Figures

DISPOSABLE UNDERARM PERSPIRATION PAD

TECHNICAL FIELD

This invention relates to an underarm perspiration pad for being releasably secured in a garment proximate the underarm area to protect the garment from being stained or otherwise damaged by perspiration, while at the same time absorbing perspiration from the skin surface of the wearer of the garment to keep such wearer's underarms dry.

BACKGROUND ART

Damage to clothing by reason of perspiration stains has long been a problem, with the underarm area of a garment being particularly susceptible to such damage. In addition to the problem of perspiration stains, the absorption of perspiration by certain fabrics tends to deteriorate the fabric, thus shortening the useful life of the garment. To some extent, the use of anti-perspirants reduces the probability of perspiration damage, but even the best anti-perspirants are only partially effective. Further, conventional anti-perspirants and deodorants may reduce perspiration or mask its odor, but they often contain chemicals, which when combined with perspiration, may exacerbate the problem of fabric deterioration. Of course, in addition to the damage done to clothing by perspiration, there is the discomfort of perspiration wetness in the underarm area. Once again, anti-perspirants are only a partial solution, and deodorants do nothing at all to ease the discomfort.

Therefore, it is an object of the present invention to provide an underarm perspiration pad which protects the underarm area of a garment from perspiration stains and other perspiration related damage.

Another object of the present invention is to provide an underarm perspiration pad which absorbs perspiration from the skin surface of a wearer so as to keep the wearer's underarm dry.

Yet another object of the present invention is to provide an underarm perspiration pad which may be easily secured in a garment and easily removed from the garment after the garment has been worn.

Still another object of the present invention is to provide an underarm perspiration pad which can be inexpensively manufactured such that the pads are disposable after use.

DISCLOSURE OF THE INVENTION

Other objects and advantages will be accomplished by the present invention which provides an underarm perspiration pad for being releasably secured within a garment proximate the underarm area of such garment for protecting the garment from damage resulting from contact with perspiration and for absorbing perspiration from the underarm skin surface of the wearer of the garment. The pad of the present invention comprises a first exterior panel and a second exterior panel joined at their peripheral edges to enclose a perspiration absorbent filler. The first exterior panel contacts the skin surface of the wearer of the garment and serves to absorb perspiration from the skin of the wearer and wick such perspiration to the absorbent filler where it is retained. The second exterior panel is fabricated of a perspiration impervious material and prohibits perspiration from contacting the garment. Further, the second exterior panel is provided with means for releasably securing the pad to the garment. In one embodiment, such means comprise a suitable adhesive provided with an adhesive protection tab for covering the adhesive prior to use.

BRIEF DESCRIPTION OF THE DRAWINGS

The above-mentioned features of the invention will become more clearly understood from the following detailed description of the invention read together with the drawings in which.

BEST MODE FOR CARRYING OUT THE INVENTION

An underarm perspiration pad incorporating various features of the present invention is illustrated generally at 10 in the figures. The pad 10 is designed to be releasably secured to the interior surface of a garment 12, such as a blouse, shirt, coat, etc., proximate the underarm area 14. Thusly positioned, the pad 10 serves to protect the garment 12 from stains or other damage caused by the absorption of, or contact with, perspiration. Further, as discussed in detail below, the pad 10 serves to draw or wick perspiration from the skin surface of the wearer of the garment 12 such that the wearer's underarm is kept dry.

In the preferred embodiment illustrated in the figures, the pad 10 is substantially elliptical or oval in shape. However, it will be appreciated that the pad 10 may assume various geometric configurations, and that the illustrated embodiment depicts only one preferred configuration which has been found to be appropriate for being received in a variety of garments, while at the same time providing the desired protection against perspiration damage. Further, the overall size of the pad may vary depending upon garment size or style.

Figure 1:
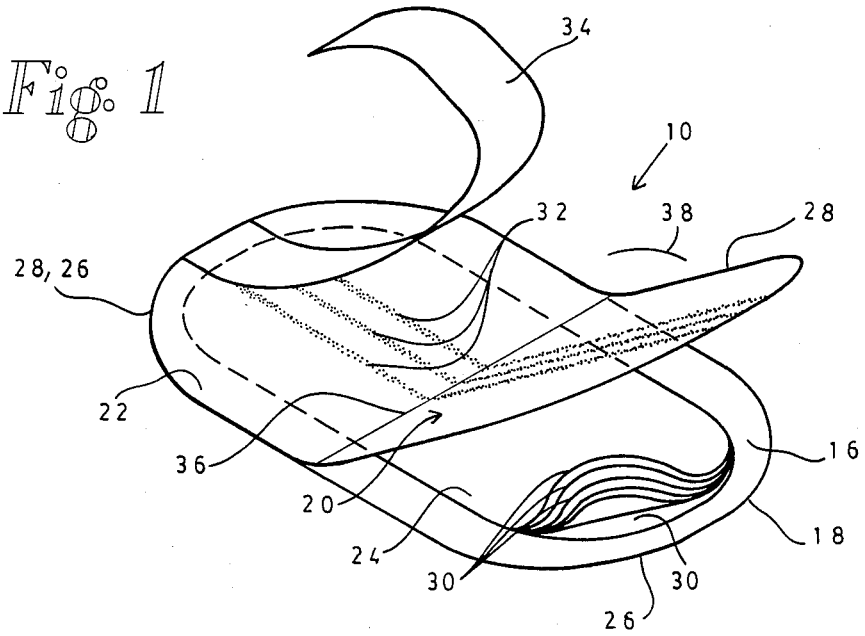
FIG. 1 illustrates a perspective view of the underarm perspiration pad of the present invention reflecting a portion of the second exterior panel folded back to expose the interior of the pad.
Figure 2:
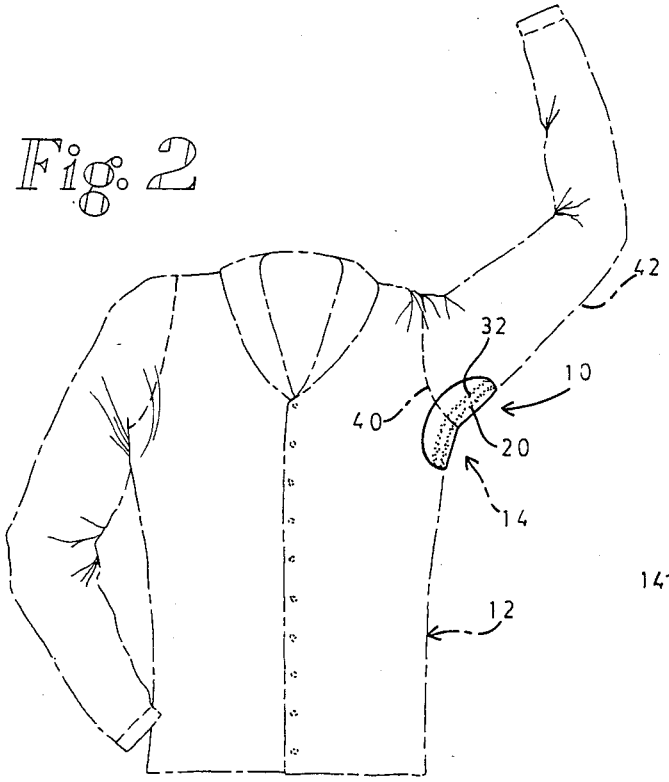
FIG. 2 illustrates a side view of the underarm perspiration pad of the present invention as it is secured in a garment.
Figure 3:
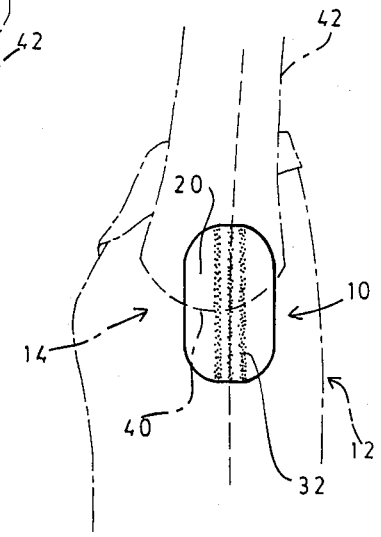
FIG. 3 illustrates a top view of the underarm perspiration pad of the present invention as it is secured in a garment.
Figure 4:
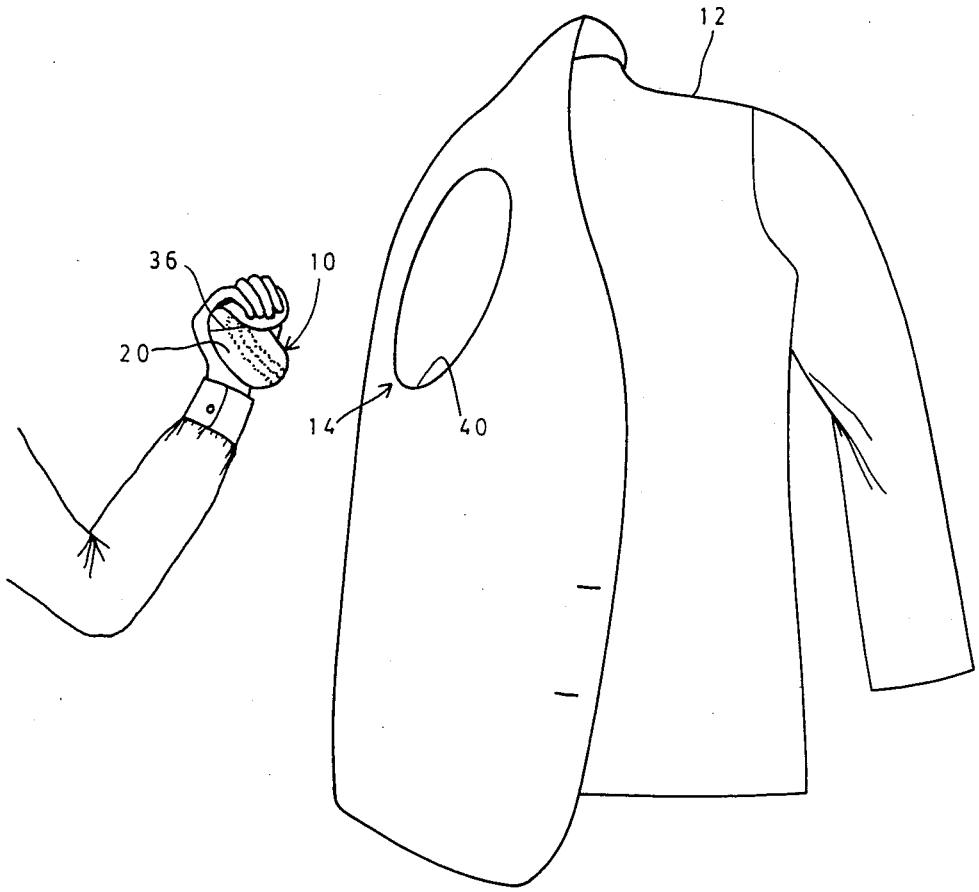
FIG. 4 illustrates an underarm perspiration pad of the present invention being inserted in a garment.

As illustrated in FIG. 1, the pad 10 comprises a first exterior panel 16 having an exterior surface 18 for contacting the skin surface of the wearer of the garment 12, and a second oppositely disposed exterior panel 20 having an exterior surface 22 for engaging the garment 12. Sandwiched between the exterior panel 16 and the exterior panel 20 is a perspiration absorbent filler 24. In order to secure the filler 24 in a position between the panels 16 and 20, the panels 16 and 20 are secured together proximate their peripheral edges 26 and 28, respectively, as for example with an adhesive.

The first exterior panel 16, being that portion of the pad 10 which contacts the wearer's skin is preferably fabricated of a hydrophobic gauze or other material which serves to absorb the perspiration of the wearer from the skin surface and wick such perspiration toward the absorbent filler 24. Further, it is desirable that the panel 16 be sufficiently soft and pliable to avoid irritation of the wearer's skin and to insure that the pad does not affect mobility. As illustrated in FIG. 1, the filler 24 preferably comprises a plurality of layered absorbent sheets 30, the sheets 30 being fabricated of a tissue like paper or an absorbent cloth. It will be appreciated that the layering of the sheets 30 of the filler 24 allows perspiration to be absorbed and trapped between the sheets 30 and thus enhances the absorption and moisture holding capacity of the filler 24. Of course, it will be understood that the filler 24 can be fabricated of cellulose, pulp, or other absorbent materials, and, at the risk of reduced efficiency, need not comprise layered sheets as in the illustrated embodiment.

The second exterior panel 20 is preferably fabricated of a perspiration impervious material such that the panel 20 forms a barrier between the filler 24 and the garment 12 which prevents perspiration trapped in the filler 24 from reaching the garment 12. In this regard, the exterior panel 20 can be fabricated of any one of numerous conventional liquid impervious materials. However, to facilitate the disposability of the pad 10, a paper material, chemically treated to be perspiration impervious, is well suited for this purpose. Further, as with the panel 16, it is desirable that the panel 20 and the filler 24 be sufficiently pliable to avoid restricting the mobility of the wearer.

In order to releasably secure the pad 10 in position proximate the underarm area 14 of the garment 12, the exterior surface 22 of the second exterior panel 20 is provided with a suitable adhesive 32. A removable adhesive protection tab 34 is also provided to cover and protect the adhesive 32 until such time as the pad 10 is to be used, at which time the tab 34 is pulled from the adhesive 32 and the pad 10 is pressed into place proximate the underarm area 14 of the garment 12. Further, in order to facilitate the positioning of the pad 10 within the garment 12, and to insure that the pad 10 does not obstruct mobility, in the preferred embodiment of the figures, the pad 10 is provided with a centrally disposed crease 36 which facilitates the folding of the pad 10 in the direction indicated by arrow 38. Thus, when securing the pad 10 to the garment 12, the pad 10 is positioned such that the crease 36 is aligned along the underarm seam 40 of the garment 12. Resultantly, the fold in the pad 10 created by the crease 36 overlaps the natural fold in the garment 12 created by the seam 40 such that movement of the sleeve 42 of the garment 12 is not restricted or hampered by the pad 10.

Therefore, it will be appreciated that the underarm perspiration pad 10 can be secured proximate each underarm area 14 of a garment 12 in order to protect the garment from perspiration damage and to keep the wearer's underarms dry. In this regard, the hydrophobic first exterior panel 16 serves to absorb perspiration from the skin of the wearer and wick the perspiration toward the absorbent sheets 30 which make up the filler 24. Accordingly, the wearer's underarms are kept dry with the perspiration being trapped in the filler 24. Further, the perspiration impervious second exterior panel 20 prohibits the perspiration trapped in the filler 24 from reaching the garment 12, thereby obviating the perspiration damage to the garment 12. Of course, after the garment has been worn, the pads 10 may be removed from the garment and disposed of, and new pads 10 may be inserted when the garment 12 is worn again. Additionally, in the preferred embodiment, the pads 10 are impregnated with a deodorant to obviate any offensive odor emanating from the perspiration absorbed by the pads 10. Of course, the pads 10 may be provided with an artificial scent or may be unscented as desired, and may be provided in various colors such that they will match the color of the garment to which they are secured so that they are not visible through the weave of the cloth of the garment.

While a preferred embodiment has been shown and described, it will be understood that there is no intent to limit the invention to such disclosure, but rather it is intended to cover all modifications and alternate constructions falling within the spirit and scope of the invention as defined in the appended claims.

I claim:

1. A disposable underarm perspiration pad adapted for being folded along a transverse crease for being releasably secured within a garment proximate the underarm area of said garment for protecting said garment from damage resulting from contact with perspiration, and for absorbing perspiration from the skin surface of the wearer of said garment, said underarm perspiration pad comprising:

a first exterior panel having an exterior surface for contacting said skin surface of said wearer, said first exterior panel serving to wick said perspiration from said skin surface of said wearer;

a substantially perspiration impervious second exterior panel having an exterior surface for contacting said garment;

a perspiration absorbent filler mounted between said first exterior panel and said second exterior panel, said filler serving to absorb and retain said perspiration; and attachment means provided on said external surface of said second exterior panel for releasably securing said pad in said garment, said attachment means extending across said crease and being substantially perpendicular to said crease.

2. The underarm perspiration pad of claim 1 wherein said perspiration absorbent filler comprises a plurality of perspiration absorbent sheets selectively disposed in layers.

3. The underarm perspiration pad of claim 1 wherein said first exterior panel and second exterior panel each define peripheral edge portions and said first exterior panel and said second exterior panel are secured together proximate said peripheral edge portions so as to secure said filler between said first exterior panel and said second exterior panel.

4. The underarm perspiration pad of claim 3 wherein said attachment means for releasably securing said pad in said garment comprises at least one strip of an adhesive carrier on said exterior surface of said second exterior panel, said strip extending to said peripheral edge of said second panel.

5. The underarm perspiration pad of claim 4 wherein said pad is provided with an adhesive protection tab for removably covering said adhesive until such time as said pad is to be secured in said garment.

6. The underarm perspiration pad of claim 3 wherein said peripheral edges of said first and second exterior panels define an oval having a long axis and a short axis, said crease is transverse to said long axis, and said attachment means are a plurality of strips of an adhesive extending to said peripheral edges carried on said external surface of said second exterior panel and oriented substantially perpendicular to said crease.

7. The underarm perspiration pad of claim 1 wherein said first exterior panel is fabricated of a hydrophobic material for absorbing said perspiration from said skin surface and wicking said perspiration toward said absorbent filler.

8. A disposable underarm perspiration pad adapted for being folded along a transverse crease for being releasably secured within a garment proximate the underarm area of said garment for protecting said garment from damage resulting from contact with perspiration, and for absorbing perspiration from the skin surface of the wearer of said garment, said underarm perspiration pad comprising:

a first exterior panel comprising an exterior surface for contacting said skin surface of said wearer, and defining a peripheral edge portion, said first exterior panel being fabricated of a hydrophobic material for wicking said perspiration from said skin surface;

a substantially perspiration impervious second exterior panel comprising an exterior surface, and defining a peripheral edge portion for being secured to said peripheral edge portion of said first exterior panel;

attachment means carried on said exterior surface of said second exterior panel for releasably securing said pad to said garment, said attachment means comprising at least one strip of an adhesive extending across said crease and oriented substantially perpendicular to said crease, and an adhesive protection tab for releasably covering said adhesive strip until said pad is to be secured in said garment; and a perspiration absorbent filler mounted between said first exterior panel and said second exterior panel for absorbing and retaining said perspiration, said filler comprising a plurality of perspiration absorbent sheets selectively disposed in layers.

9. The underarm perspiration pad of claim 8 wherein said peripheral edges of said first and second exterior panels define an oval having a long axis and a short axis, said crease is transverse to said long axis, and said attachment means are a plurality of strips of an adhesive extending to said peripheral edges carried on said external surface of said exterior panel and oriented substantially perpendicular to said crease.

* * * * *